US008635879B2

(12) United States Patent
Ryu et al.

(10) Patent No.: US 8,635,879 B2
(45) Date of Patent: Jan. 28, 2014

(54) HEAT PUMP AND METHOD OF CONTROLLING THE SAME

(75) Inventors: Byoungjin Ryu, Changwon-si (KR); Yonghee Jang, Changwon-si (KR)

(73) Assignee: LG Electronics Inc., Seoul (KR)

( * ) Notice: Subject to any disclaimer, the term of this patent is extended or adjusted under 35 U.S.C. 154(b) by 251 days.

(21) Appl. No.: 13/301,850

(22) Filed: Nov. 22, 2011

(65) Prior Publication Data

US 2012/0125024 A1 May 24, 2012

(30) Foreign Application Priority Data

Nov. 23, 2010 (KR) ..... 10-2010-0117020

(51) Int. Cl.
*F25B 49/02* (2006.01)

(52) U.S. Cl.
USPC ..... 62/196.1; 62/197; 62/510; 62/513

(58) Field of Classification Search
USPC ..... 62/115, 513, 324.3, 160, 196.1, 197, 62/225, 510
See application file for complete search history.

(56) References Cited

U.S. PATENT DOCUMENTS 5,899,091 A * 5/1999 Fraser et al. ..... 62/473
6,343,482 B1 * 2/2002 Endo et al. ..... 62/324.6
2006/0266074 A1 * 11/2006 Groll et al. ..... 62/510
2008/0314055 A1 * 12/2008 Lifson ..... 62/196.3
2010/0192607 A1 * 8/2010 Unezaki et al. ..... 62/238.7

FOREIGN PATENT DOCUMENTS

JP 04278149 A * 10/1992
JP 10148412 A * 6/1998
JP 10-325622 12/1998
JP 2005-274085 10/2005
JP 2005274085 A * 10/2005
JP 2007178052 A * 7/2007
JP 2009236441 A * 10/2009
JP 2010-156536 7/2010

OTHER PUBLICATIONS

Korean Office Action issued in KR Application No. KR 10-2010-0117020 dated Jun. 12, 2012.

* cited by examiner

*Primary Examiner* — Allana Lewin
*Assistant Examiner* — Kun Kai Ma
(74) *Attorney, Agent, or Firm* — KED & Associates, LLP

(57) ABSTRACT

A heat pump and a method of controlling a heat pump are provided. The heat pump may perform gas injection through a plurality of coolant injection circuits formed in a compressor, such as a scroll compressor, to increase a corresponding flow rate. The heat pump may control the plurality of coolant injection circuits based on one or more operation conditions by selecting an appropriate optimal middle pressure from a high-and-low pressure difference, a pressure ratio, and a compression ratio of the compressor to enhance cooling/heating performance.

14 Claims, 7 Drawing Sheets

HEAT PUMP AND METHOD OF CONTROLLING THE SAME

CROSS-REFERENCE TO RELATED APPLICATION(S)

This application claims priority under 35 U.S.C. §119 to Korean Application No. 10-2010-0117020 filed in Korea on Nov. 23, 2010, whose entire disclosure is hereby incorporated by reference.

BACKGROUND

1. Field

Embodiments are directed to a heat pump and a method of controlling the heat pump, and more specifically to a heat pump that may perform gas injection through a plurality of coolant injection circuits properly formed in a scroll compressor for increasing the flow rate, wherein the heat pump may control the plurality of coolant injection circuits depending on an operation condition by selecting the optimal middle pressure from a high-and-low pressure difference, a pressure ratio, and a compression ratio of the scroll compressor and a method of controlling the heat pump.

2. Background

In general, heat pumps compress, condense, expand, and evaporate a coolant to heat or cool a room. A heat pump may include a compressor, a condenser, an expansion valve, and an evaporator. The coolant discharged from the compressor is condensed by the condenser and then expanded by the expansion valve. The expanded coolant is evaporated by the evaporator and is then sucked into the compressor.

Heat pumps are classified into regular air conditioners each having an outdoor unit and an indoor unit connected to the outdoor unit, and multi air conditioners each having an outdoor unit and a plurality of indoor units connected to the outdoor unit. A heat pump may also include a hot water feeding unit for supplying hot water and a floor heating unit for heating a floor using supplied hot water.

BRIEF DESCRIPTION OF THE DRAWINGS

The embodiments will be described in detail with reference to the following drawings in which like reference numerals refer to like elements wherein.

DETAILED DESCRIPTION

Figure 1:
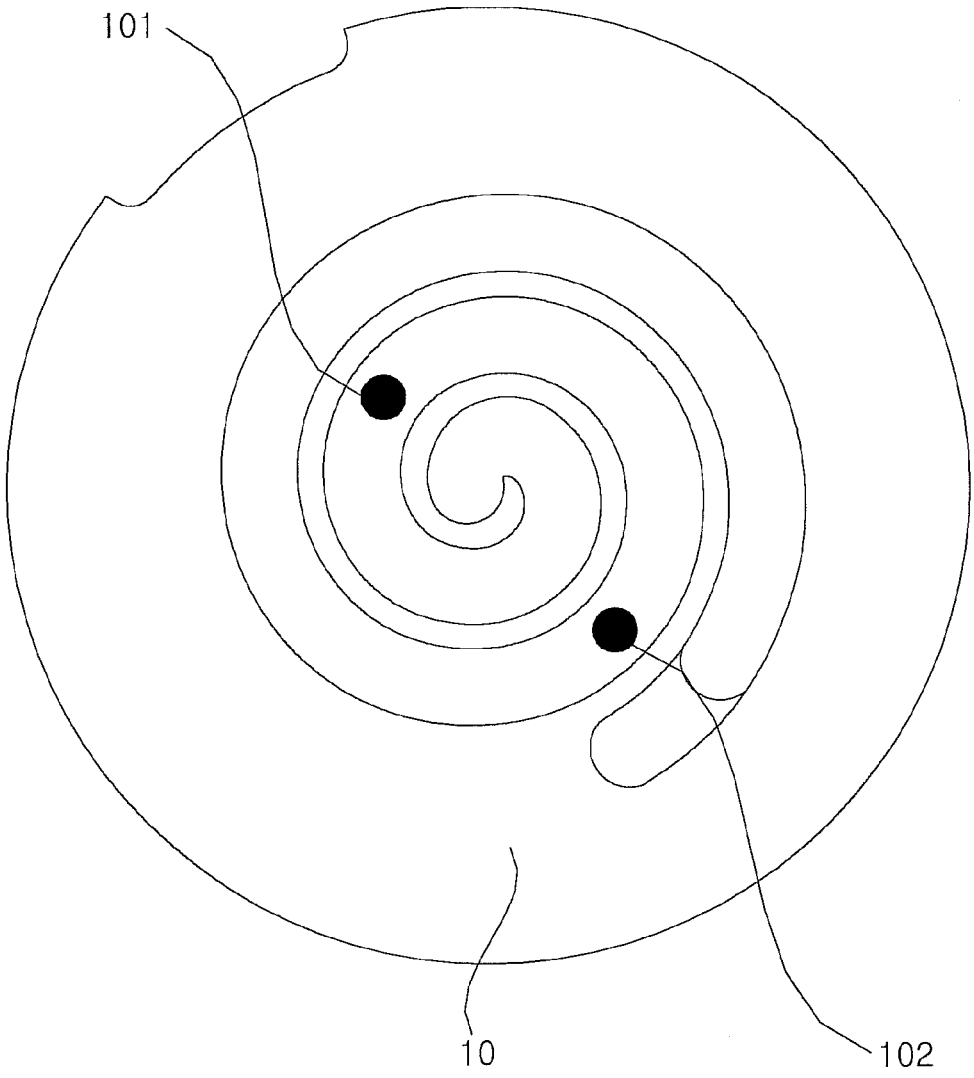
FIG. 1 is a conceptual view of a scroll compressor according to an embodiment as broadly described herein, in which a plurality of coolant injection circuits are connected to the scroll compressor.
Figure 2:
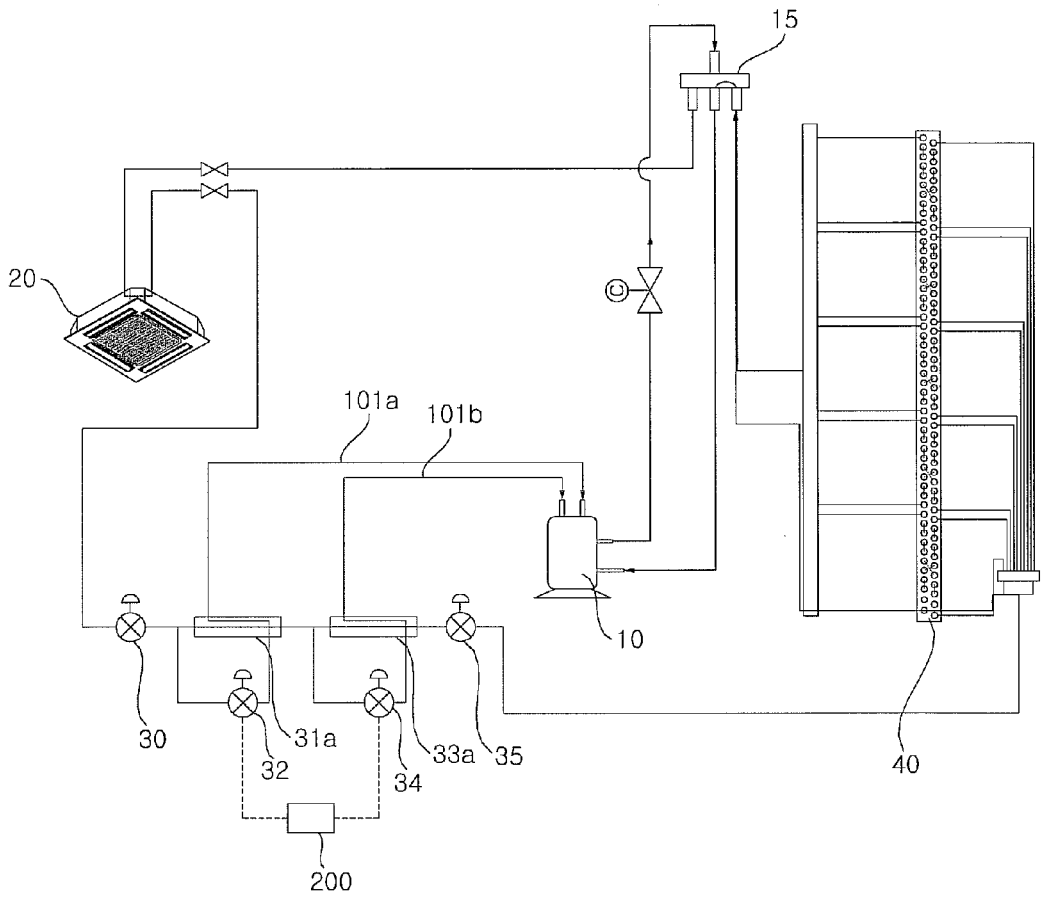
FIG. 2 is a pneumatic circuit diagram of a coolant flow in a heat pump according to an embodiment as broadly described herein, in which the heat pump includes an internal heat exchanger.
Figure 3:
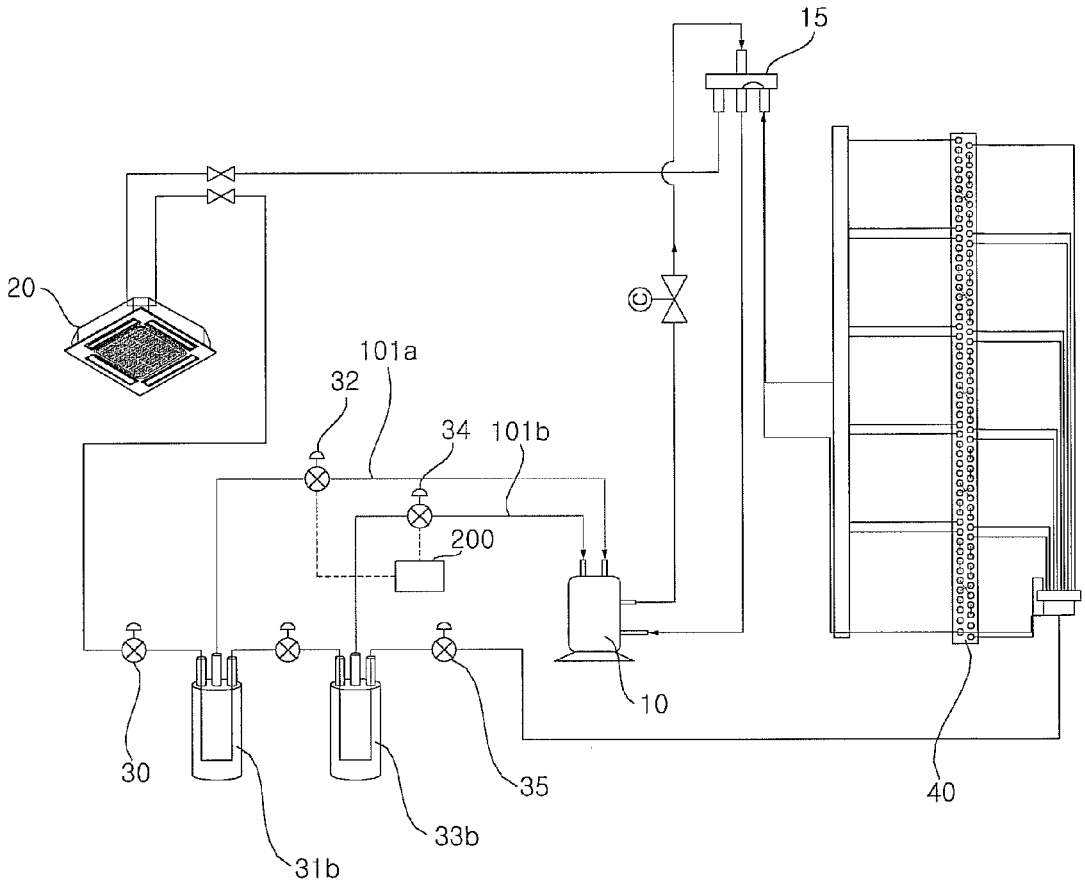
FIG. 3 is a pneumatic circuit diagram of a coolant flow in a heat pump according to an embodiment as broadly described herein, in which the heat pump includes a gas-liquid separator.

In certain circumstances, a heat pump may not provide sufficient cooling/heating performance when cooling/heating loads, such as an outdoor temperature, are changed. For example, a heat pump may suffer from a lowering in heating performance in a low temperature region. To address this problem, a high-capacity heat pump may be employed or a new heat pump may be added to an existing system. However, this may increase costs and decrease available installation space. Components of a heat pump as embodied and broadly described herein are shown in FIGS. 1-3. Simply for ease of discussion, the following description will focus on an example in which an indoor heat exchanger 20 functions as a condenser 20 for room heating. However, the embodiments are not limited thereto, and may also apply to an example in which heat exchanger 20 serves as an evaporator for room cooling.

As shown in FIGS. 2 and 3, a heat pump according to an embodiment as broadly described herein may include a coolant main circuit including a compressor 10 for compressing a coolant, an indoor heat exchanger 20 for condensing the coolant passing through the compressor 10, an outdoor expander 35 for expanding the coolant passing through the indoor heat exchanger 20, an outdoor heat exchanger 40 for evaporating the coolant passing through the outdoor expander 35 and a switching valve 15 for switching a flow of the coolant for selecting room cooling or room heating. In this exemplary embodiment, the compressor 10 may be a scroll compressor 10. However, other types of compressors may be appropriate, based on a particular application.

During a room heating mode operation, one or both of the outdoor expander 35 and/or the indoor expander 30 may be activated. The activation may be performed by adjusting the degree of opening.

The heat pump may also include a first coolant injection circuit 101*a* branched from between the indoor heat exchanger 20 functioning as a condenser and the outdoor heat exchanger 40 functioning as an evaporator to allow coolant to flow through one of a coolant inlet or a coolant outlet of the compressor 10.

The heat pump may also include a second coolant injection circuit 101*b* branched from between the indoor heat exchanger 20 and the outdoor heat exchanger 40 to allow a coolant to flow through one of the coolant inlet or the coolant outlet of the compressor 10.

For ease of description, the portion of the compressor 10 where the first coolant injection circuit 101*a* is connected may hereinafter be referred to as a "first coolant port" 101, and the portion of the compressor 10 where the second coolant injection circuit 101*b* is connected may hereinafter be referred to as a "second coolant port 102".

A first expander 32 may be arranged over the first coolant injection circuit 101*a* and branched from the coolant main circuit to expand the flowing coolant to a predetermined pressure, and a second expander 32 may be arranged over the second coolant injection circuit 101*b* and branched from the coolant main circuit to expand the flowing coolant to a predetermined pressure.

For ease of description, a process in which the coolant separately flows through the first coolant injection circuit 101*a* and the second coolant injection circuit 101*b* and is injected into the compressor 10 through one port may hereinafter be referred to as a "gas injection process".

Gas may be injected into the scroll compressor 10 through the first coolant injection circuit 101*a* and the second coolant injection circuit 101*b* is a situation in which sufficient cooling/heating capability is not attained when a cooling/heating load, such as temperature of external air, changes. For example, when the heat pump does not effectively operate based on the amount of coolant flowing into the scroll compressor 10 or a fixed compression capacity between the inlet end and outlet end of the scroll compressor 10, it may be possible to actively secure improved/optimal operational performance using such a gas injection process.

As described above, a position of the first coolant port 101 and the second coolant port 102 of the scroll compressor 10 may be determined to obtain a maximum operational performance of the scroll compressor 10 for each operation mode.

In the example shown in FIG. 1, the first coolant port 101 and the second coolant port 102 are arranged at different locations between the coolant inlet and the coolant outlet of the scroll compressor 10.

For example, one of the first coolant port 101 or the second coolant port 102 is arranged closer to the coolant inlet of the scroll compressor 10 and becomes a low pressure side coolant port, and the other is arranged closer to the coolant outlet of the scroll compressor 10 becomes a high pressure side coolant port. This is because a pressure ratio of the scroll compressor 10 decreases closer to the coolant inlet and increases closer to the coolant outlet. In the event that an internal state of the scroll compressor 10 is expressed as a compression ratio, the compression ratio decreases toward the coolant inlet and increases toward the coolant outlet. If the internal state of the scroll compressor 10 is represented as a volume ratio, a reverse relationship applies, and the volume ratio increases toward the coolant inlet and decreases toward the coolant outlet.

The volume ratio of the scroll compressor 10 may be determined by a cycle volume ratio (R)=(V1/V2). For example, assuming that a specific volume of coolant corresponding to a pressure of the coolant inlet of the scroll compressor 10 is V1 and a specific volume of coolant corresponding to each injection pressure of the first coolant injection circuit 101*a* or the second coolant injection circuit 101*b* is V2, V1/V2=R, and thus, each injection pressure of the first coolant injection circuit 101*a* or the second coolant injection circuit 101*b* may be calculated by obtaining V2 followed by a pressure corresponding to V2. The pressure corresponding to V2 refers to an optimal middle pressure of the first coolant injection circuit 101*a* and the second coolant injection circuit 101*b*. Since an evaporation temperature may be fixed based on the Mollier diagram, the pressure corresponding to V2 may be set as an ideal middle pressure.

The optimal middle pressure of coolant injected through the first coolant injection circuit 101*a* or the second coolant injection circuit 101*b* may play a role as a material variable to select corresponding appropriate positions of the first coolant port 101 and the second coolant port 102.

However, even after establishing respective positions the first coolant port 101 and the second coolant port 102 of the scroll compressor 10 where the first coolant injection circuit 101*a* and the second coolant injection circuit 101*b* are respectively connected, the first coolant injection circuit 101*a* and the second coolant injection circuit 101*b* are not necessarily activated.

In the interest of maintaining reliability of the scroll compressor 10, coolant injected into the scroll compressor 10 should not be a liquid coolant, based on a supercooling degree of a coolant.

The supercooling degree of a coolant refers to a variation in condensation saturation temperature of a condenser, for example, a difference in temperature between the condensation saturation temperature of the coolant and a temperature of the coolant before the coolant is expanded by the expander.

A coolant having a supercooling degree may indicate that, of the first and second coolant injection circuits 101*a* and 101*b* each set based on the optimal middle pressure, the first coolant injection circuit 101*a*, which is first branched from the coolant main circuit and is connected to the coolant outlet that is a high pressure side of the scroll compressor 10, needs to be activated.

However, even when the first coolant injection circuit 101*a* is activated in response to an indication that the supercooling degree of coolant is high, that is, even in the case in which gas injection is performed to achieve the optimal middle pressure associated with the first coolant injection circuit 101*a*, in consideration of reliability of the scroll compressor 10, the coolant injected through the first coolant injection circuit 101*a* should not be a liquid coolant. This situation may cause the first coolant injection circuit 101 to be de-activated.

For the coolant flowing into the scroll compressor 10 to be transformed to a gaseous state but not to a supercooled liquid state, the first expander 32 and the second expander 34 expand the coolant branched from the coolant main circuit to a low pressure, thereby relieving the supercooling degree to some extent. However, the optimal middle pressure of coolant injected through the first coolant injection circuit 101*a* and the second coolant injection circuit 101*b* is preset as an ideal middle pressure, and pressure expanded by the first expander 32 and the second expander 34 (that is, evaporation pressure of coolant injected through the first coolant injection circuit 101*a* and evaporation pressure of coolant injected through the second coolant injection circuit 101*b*) may be somewhat limited.

To prevent this problem in advance, cooling flow a structure may include a first coolant injection circuit 101*a* separately configured for gas injection and a second coolant injection circuit that prevents supercooled liquid coolant from being injected.

However, a structure that prevents such gas injection even when gas injection is required cannot typically respond to consumers' demand. As such, for the coolant expanded by the first expander 32 and the second expander 34 in a low pressure to be transformed into a supercooled liquid coolant, as shown in FIGS. 2 and 3, internal heat exchangers 31*a* and 33*a* may be provided to evaporate the supercooled liquid coolant, or a gas-liquid separators 31*b* and 33*b* may be provided to separate liquid and gaseous coolants from each other so that only the gaseous coolant is subjected to gas injection.

The supercooling degree of coolant which causes the coolant to be gas injected through the first coolant injection circuit 101*a* and the second coolant injection circuit 101*b* and the state of the coolant depending on various variables in the scroll compressor 10 have a material influence on positions of the first coolant port 101 and the second coolant port 102 on the scroll compressor 10.

As described above, the first coolant port 101 and the second coolant port 102 are positioned at two different locations between the coolant inlet and the coolant outlet of the compressor 10.

Although the first coolant port 101 and the second coolant port 102 are physically set at the two different locations, the compression ratio, pressure ratio, and supercooling degree of the compressor 10 may vary depending on the temperature of external air or load value required for each operation mode of the heat pump. Under this situation, the supercooling degree of the coolant may be still problematic.

Figure 4A:
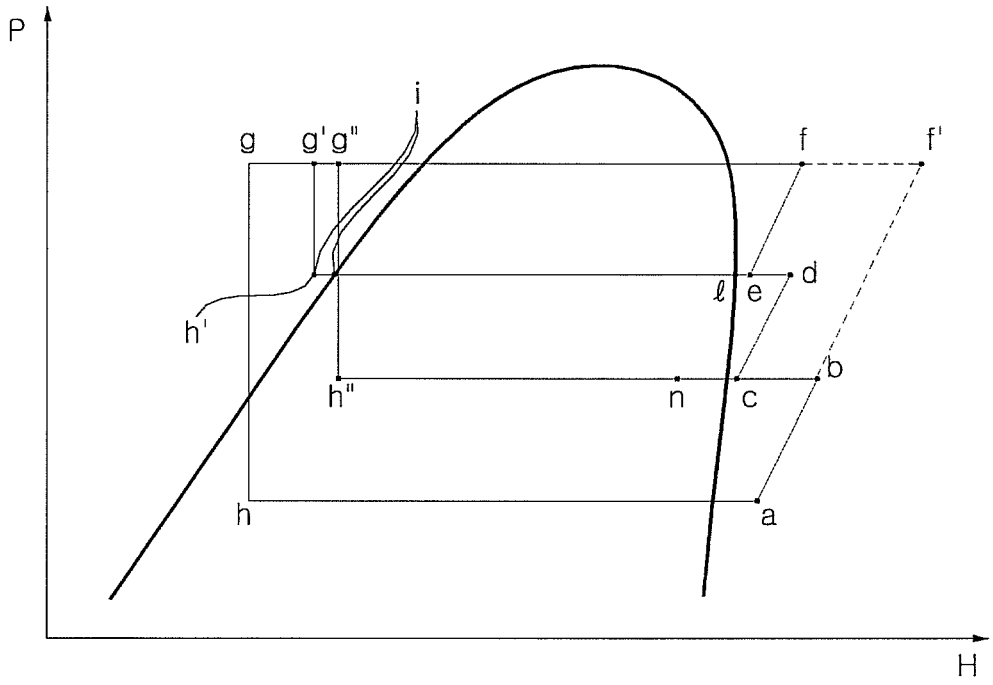
FIGS. 4A and 4B are P-H diagrams for describing the gas injection control performed in FIG. 2.
Figure 5A:
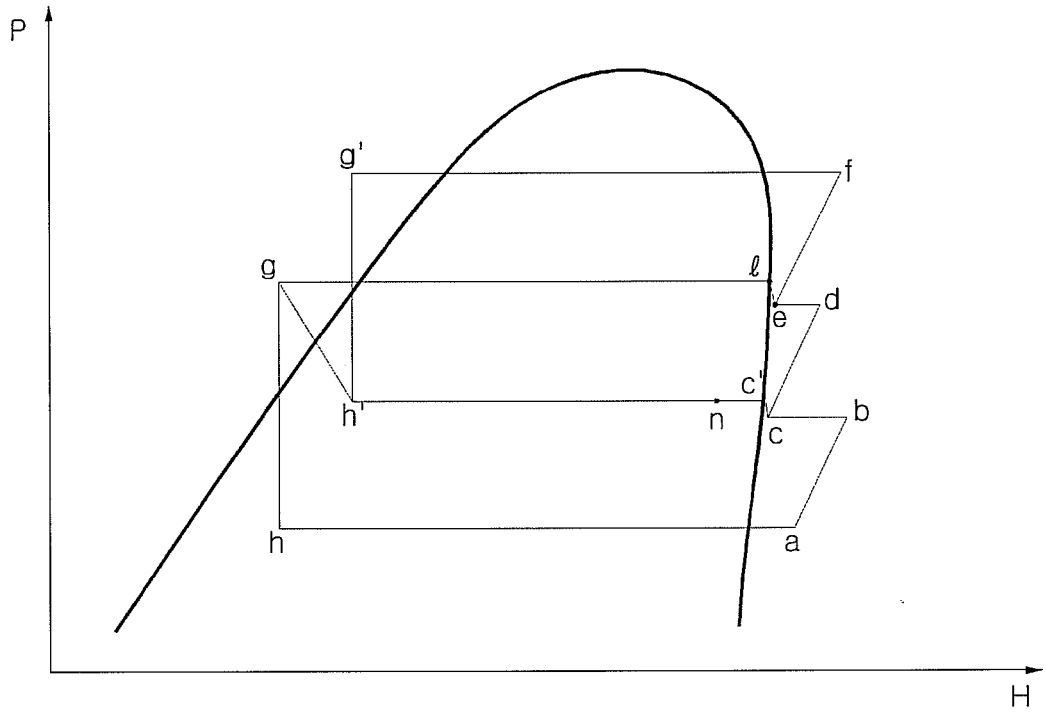
FIGS. 5A and 5B are P-H diagrams for describing the gas injection control performed in FIG. 3.

FIGS. 4A and 5A are P-H diagrams illustrating examples where, in a heat pump as embodied and broadly described herein, gas injection is inappropriate when coolant is in a supercooled liquid state before the coolant is introduced into the compressor 10.

Referring to FIGS. 4A and 5A, coolant evaporated by the outdoor heat exchanger 40 is compressed and overheated up to point f' by the scroll compressor 10 in the case that no gas injection is present at point a.

However, in the case that there is two-stage gas injection through the first coolant port 101 and the second coolant port 102, coolant is first compressed up to point b by the scroll compressor 10, and the first compressed coolant is mixed with the gas injected coolant by the first coolant port 101 or the second coolant port 102 so that its enthalpy is lowered, and is thus transformed to a state as in point c. The coolant is then kept compressed up to point d, and mixed with the gas injected coolant by the first coolant port 101 or the second coolant port 102 to be converted to a state as in point e. Then, continuous compression leads the coolant to a state as in point f.

As shown in FIG. 4A, without gas injection, the coolant condensed and then supercooled by the indoor heat exchanger 20 up to point g is expanded by the outdoor expander 35 to point h, and then introduced into the inlet portion of the scroll compressor 10. Under this situation, the coolant is not in the supercooled liquid state, thus resulting in no problem.

However, as shown in FIG. 4A, to perform gas injection by the first coolant port 101 or the second coolant port 102, the liquid coolant supercooled at point g' or g" needs to be expanded by the first expander 32 or the second expander 34 up to an optimal middle pressure. The expansion from point g" to point h" is not problematic since the coolant is not in the supercooled liquid state. However, when the coolant is expanded from point g' to point h', gas injection becomes inappropriate because supercooled liquid coolant co-exists at point h'.

Important in selection of the most appropriate locations for the first coolant port 101 and the second coolant port 102 of the scroll compressor 10 are points l and n where gas injection is carried out by the scroll compressor 10. In selecting the points, an optimal middle pressure associated with all the variables, such as an operating ratio or capacity of the heat pump, which corresponds to a required load value, may be first selected.

The optimal middle pressure is pre-determined while selecting the first coolant port 101 and the second coolant port 102 which are respectively connection ports of the first coolant injection circuit 101*a* and the second coolant injection circuit 101*b*. Accordingly, under the circumstance shown in FIG. 4A, expanding the coolant from point g" to point h" rather than activating the second coolant injection circuit 101*b*, which increases the supercooling degree of coolant, substantially eliminates the supercooled liquid coolant. Thus, the first coolant injection circuit 101*a* may be activated.

Figure 4B:
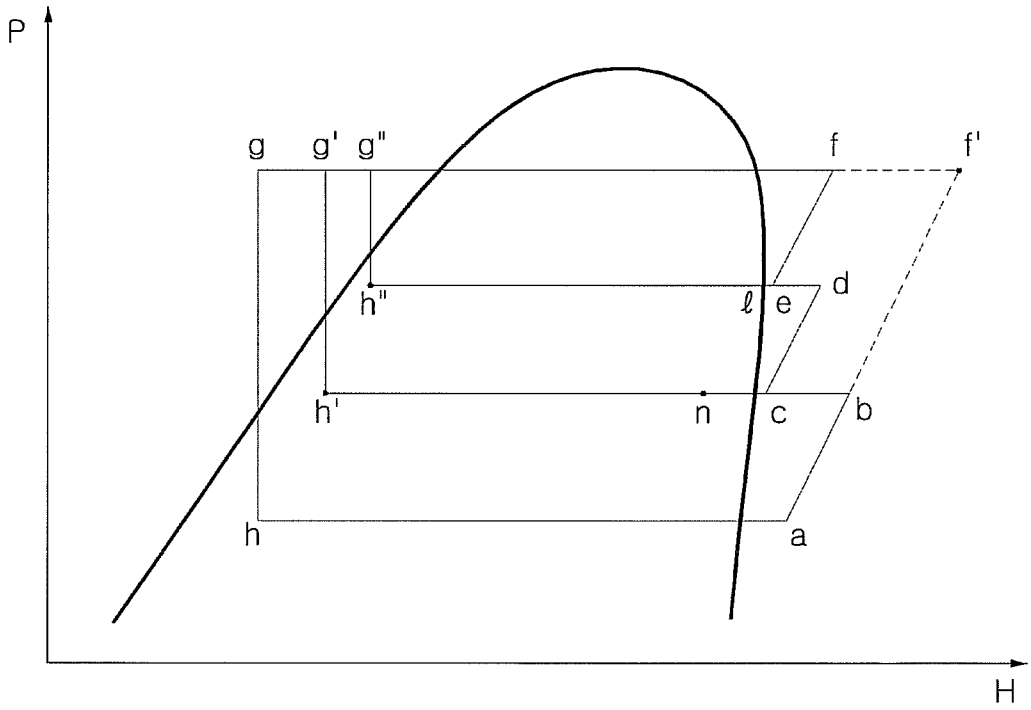

For example, if the first coolant port 101 and the second coolant port 102 are positioned so that a middle pressure for being subject to gas injection through the first coolant port 101 is chosen as shown in FIG. 4B and a middle pressure for being subject to gas injection through the second coolant port 102 is chosen as shown in FIG. 4B, none of the coolant is in the supercooled liquid state and optimal operation performance, originally achieved by the gas injection technology, may be thus obtained.

Figure 5B:
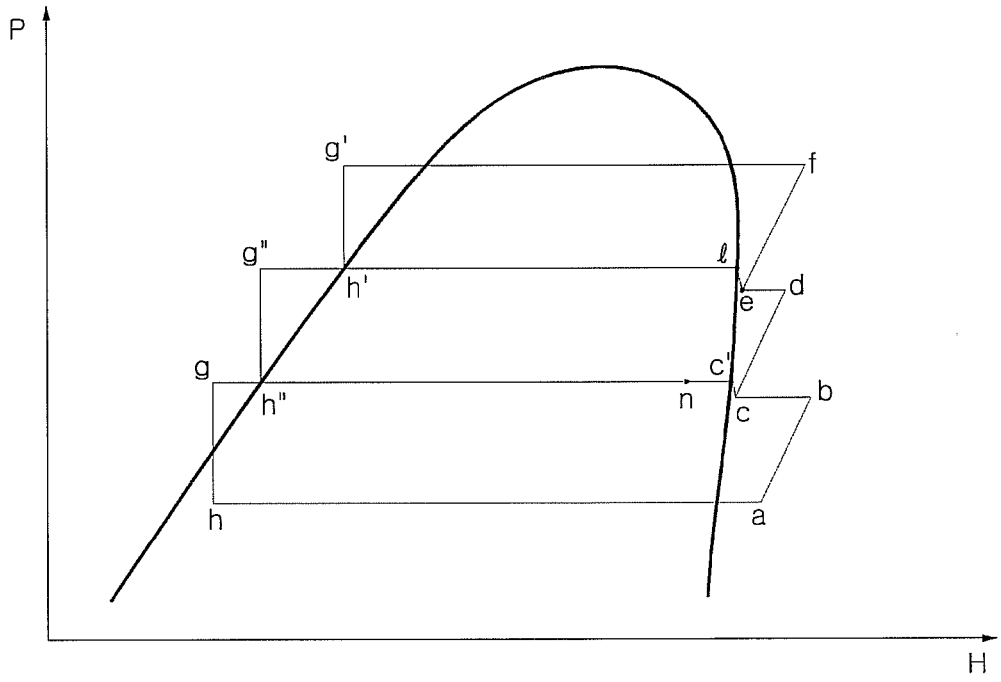
Figure 6A:
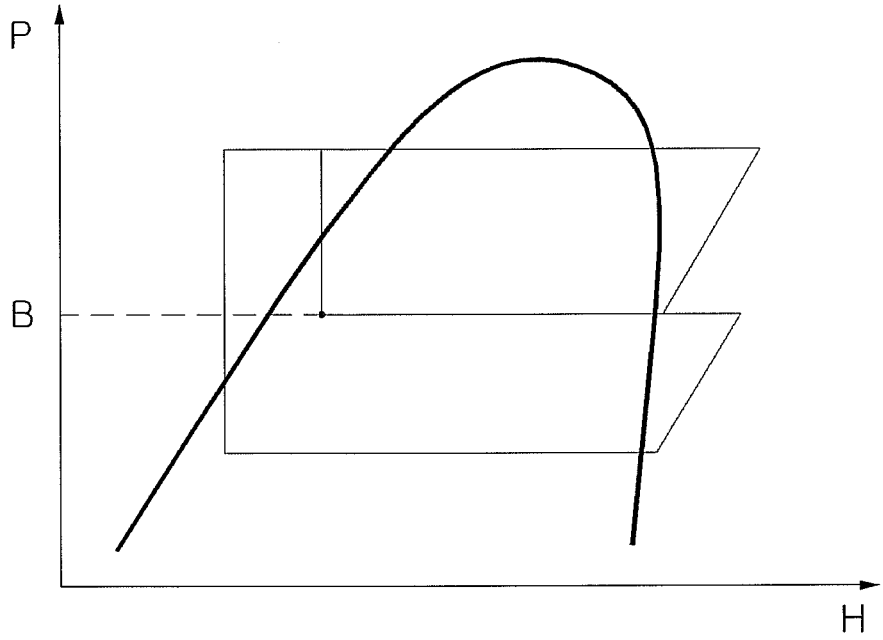
FIGS. 6A and 6B are P-H diagrams for optimal control of the coolant injection circuits of the scroll compressor shown in FIG. 1.
Figure 6B:
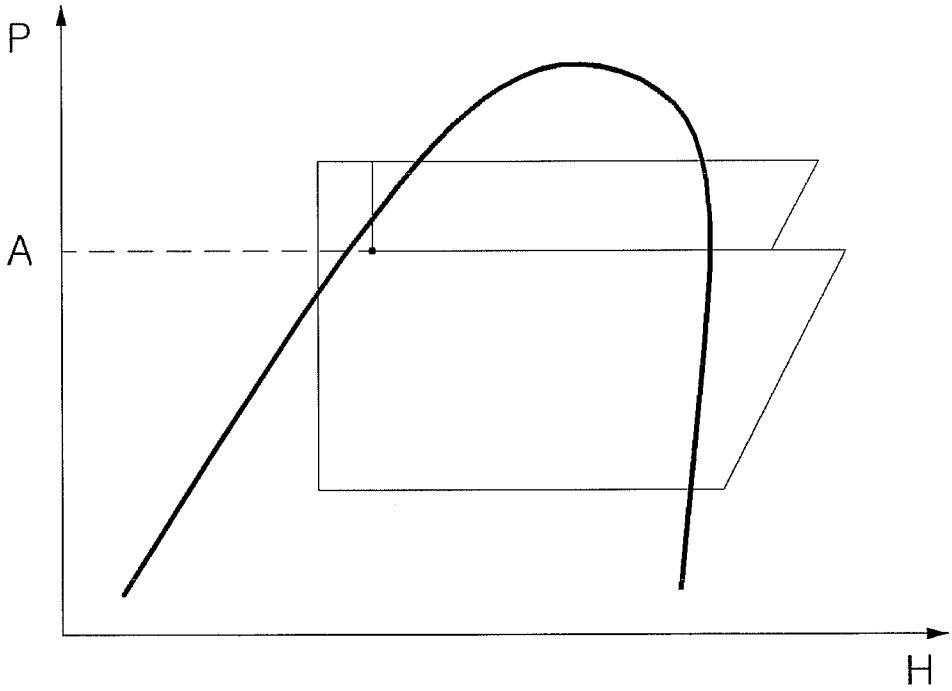

As shown in FIGS. 5A and 5B, despite the fact that, of coolants passing through the gas-liquid separator, only the gaseous coolant should be gas injected through the first coolant port 101 or the second coolant port 102, in the case that a middle pressure is selected as shown in FIG. 5A, the gaseous coolant passing through the gas-liquid separator is mixed with the supercooled liquid coolant whose state is at point g. Accordingly, this may cause an inappropriate middle pressure to be selected due to mixture of the supercooled liquid coolant.

Thus, as shown in FIG. 5B, a point where the middle pressure is selected may be set higher than as shown in FIG. 5A. However, as described earlier, even though gas injection is conducted as shown in FIG. 5B, the optimal middle pressure of coolant injected through the first coolant injection circuit 101*a* and the second coolant injection circuit 101*b* is preset as selection of the coolant ports 102 and 103. Accordingly, the supercooling degree may still be problematic.

In a heat pump as embodied and broadly described herein, the first coolant injection circuit 101*a* and the second coolant injection circuit 101*b* are respectively connected to the first coolant port 101 and the second coolant port 102 at selected locations so that optimal operation performance may be obtained at the position corresponding to the preset middle pressure, and the first coolant injection circuit 101*a* or the second coolant injection circuit 101*b* are selectively activated based on a highness-and-lowness difference of the coolant in the scroll compressor, which is a variable for selecting the supercooling degree of each coolant and the optimal middle pressure. However, the embodiments are not limited thereto.

A technical feature of embodiments as broadly described herein lies on selecting the locations of the first coolant port 101 and the second coolant port 102 to provide the preset optimal middle pressure and determining whether to activate the first coolant injection circuit 101*a* and/or the second coolant injection circuit 101*b*. Another technical feature of embodiments as broadly described herein is to utilize the supercooling degree of coolant passing through the condenser as a variable for judging the state of the coolant flowing through the first coolant injection circuit 101*a* and the second coolant injection circuit 101*b* to determine whether to activate the first coolant injection circuit 101*a* and/or the second coolant injection circuit 101*b*.

According to an embodiment as broadly described herein, the first coolant injection circuit 101*a* which is first branched from the coolant main circuit between the indoor heat exchanger 20 and the outdoor heat exchanger 40 may be connected to the first coolant port 101 which is a high pressure side port of the scroll compressor 10, and the second coolant injection circuit 101*b* which is branched from the coolant main circuit between the indoor heat exchanger 20 and the outdoor heat exchanger 40 later than, or downstream from, the first coolant injection circuit 101*a* may be connected to the second coolant port 102 which is a low pressure side port of the scroll compressor 10.

Further, according to the embodiments as broadly described herein, the optimal middle pressure is set, a position is chosen for each of the coolant ports 102 and 103, and then the optimal pressure is provided so that gas injection is carried out by the first expander 32 and the second expander 34 to correspond to various required load values according to the operating ratio of the heat pump including the temperature of external air.

The heat pump may also include a controller 200 for controlling the operation of the first expander 32 and the second expander 34.

If the heat pump is fed with power for room heating and is turned on, then the controller 200 fully opens the outdoor expander 35.

Further, the controller 200 closes or controls both the first expander 32 and the second expander 34 to prevent liquid coolant from flowing into the scroll compressor 10 through the first coolant injection circuit 101*a* and the second coolant injection circuit 101*b* at the early stage of activating the heat pump. Accordingly, at the early stage of activating the heat pump, reliability may be secured by closing the first expander 32 and the second expander 34.

When the scroll compressor 10 begins to be activated, the controller 200 first judges whether to inject the coolant to provide the optimal middle pressure of one of the first coolant injection circuit 101*a* and/or the second coolant injection circuit 101*b* from a number of variables based on the overall required load value of the heat pump and then judges the supercooling degree of the coolant introduced to the corresponding coolant injection circuit 101*a* and/or 101*b*, thereby controlling whether to activate the first coolant injection circuit 101*a* and/or the second coolant injection circuit 101*b*.

For example, if gas injection is requested, the controller 200 may selectively open one or both of the first expander 32 and/or the second expander 34 depending on the heating load, for example, temperature of external air, or may sequentially open both the first expander 32 and the second expander 34, or may simultaneously open the first expander 32 and the second expander 34 for swift response.

In other words, the controller 200 may perform control so that the coolant of the heat pump may reach the preset middle pressure.

If there is a request for gas injection, the controller 200 may open at least one of the first expander 32 or the second expander 34. Depending on the heating load, for example, the temperature of external air, the controller 200 may selectively open the first expander 32 and the second expander 34.

If the heating load is less than a predetermined load condition, the controller 200 may open only the first expander 32 while closing the second expander 34.

If only the first expander 32 is opened, the coolant flowing through the first coolant injection circuit 101*a* is gas injected into the scroll compressor 10 through the first coolant port 101.

In the gaseous state whose pressure is between the pressures of the coolant inlet and the coolant outlet of the scroll compressor 10, the gas injected coolant is introduced through the coolant inlet of the scroll compressor 10 and mixed with the coolant in the scroll compressor 10 at the preset optimal middle pressure, then continues to be compressed. Accordingly, since the gaseous coolant at the optimal middle pressure is introduced while compressed from the early pressure to the final pressure by the scroll compressor 10, reliability of the scroll compressor 10 may be enhanced by increased heating performance due to an increase in the amount of coolant.

If the heating load continues to increase, the controller 200 may open and control the second expander 34 as well. The optimal middle pressure may be primarily obtained only by adjusting the opening degree of the first expander 32, but if the heating load goes beyond a certain threshold, it may be effective to open the second expander 34.

In the case that the internal heat exchangers 31*a* and 33*a* are present, if the second expander 34 is opened, the coolant heat exchanged by the first internal heat exchanger 31*a* and further condensed flows through the second coolant injection circuit 101*b* and is then expanded by the second expander 34, then gas injected through the second coolant port 102 of the scroll compressor 10.

The optimal middle pressure of coolant injected into the scroll compressor 10 is likely lower than the optimal middle pressure of coolant injected through the first coolant injection circuit 101*a*. The coolant may be injected through the second coolant port 102 which is a low pressure side port rather than the first coolant port 101 which is a high pressure side port.

Accordingly, before the coolant injected through the first coolant injection circuit 101*a* at an early pressure is compressed to reach the optimal middle pressure by the scroll compressor 10, the coolant of the second coolant injection circuit 101*b* is gas injected to provide the optimal middle pressure that corresponds to a pressure between the early pressure and the optimal middle pressure of the first coolant injection circuit 101*a*, thus resulting in enhancement of reliability and heating performance of the scroll compressor 10.

Whether to activate the first coolant injection circuit 101*a* or the second coolant injection circuit 101*b* has been heretofore determined as described above by each supercooling degree set to provide the optimal middle pressure. However, embodiments are not limited thereto. That is, whether to activate the first coolant injection circuit 101*a* or the second coolant injection circuit 101*b* is not necessarily determined by the predetermined supercooling degree.

As described above, the optimal middle pressure of coolant injected through the first coolant injection circuit 101*a* or the second coolant injection circuit 101*b* may be determined the volume ratio VR of each of the first coolant injection circuit 101*a* and the second coolant injection circuit 101*b* or the high-and-low pressure difference of the condensed coolant and evaporated coolant. Thus, whether to activate one or both of the first coolant injection circuit 101*a* and/or the second coolant injection circuit 101*b* may be determined by the volume ratio VR or the high-and-low pressure difference of coolant.

In other words, assuming that a high-and-low pressure difference of the condensed coolant and evaporated coolant corresponding to the first middle pressure is a first predetermined high-and-low pressure difference and a high-and-low pressure difference of the condensed coolant and evaporated coolant corresponding to the second middle pressure is a second predetermined high-and-low pressure difference, when the high-and-low pressure difference of the first coolant injection circuit 101*a* is less than the first predetermined high-and-low pressure difference or the high-and-low pressure difference of the second coolant injection circuit 101*b* is more than the second predetermined high-and-low pressure difference, the corresponding coolant injection circuit may be de-activated.

In a similar manner assuming that a volume ratio of the condensed coolant and evaporated coolant corresponding to the first middle pressure is a first predetermined volume ratio VR1 and a volume ratio of the condensed coolant and evaporated coolant corresponding to the second middle pressure is a second predetermined volume ratio VR2, when the volume ratio of the first coolant injection circuit 101*a* is less than the first predetermined volume ratio VR1 or the volume ratio of the second coolant injection circuit 101*b* is more than the second predetermined volume ratio VR2, the corresponding coolant injection circuit may likewise be de-activated.

As such, the heat pump determines whether to activate the first coolant injection circuit 101*a* and the second coolant injection circuit 101*b* to correspond to the load values required by the room cooling/heating operations. The heat pump takes into consideration various variables, such as a predetermined supercooling degree, a predetermined volume ratio, and a predetermined highness-and-lowness difference for the first coolant injection circuit 101*a* or the second coolant injection circuit 101*b*, and in the event that it is not proper to activate the first coolant injection circuit 101*a* and the second coolant injection circuit 101*b*, de-activates the first coolant injection circuit 101*a* and the second coolant injection circuit 101*b*, thus enhancing reliability of the heat pump.

A method of controlling the heat pump configured as above will now be described with reference to FIG. 7.

Figure 7:
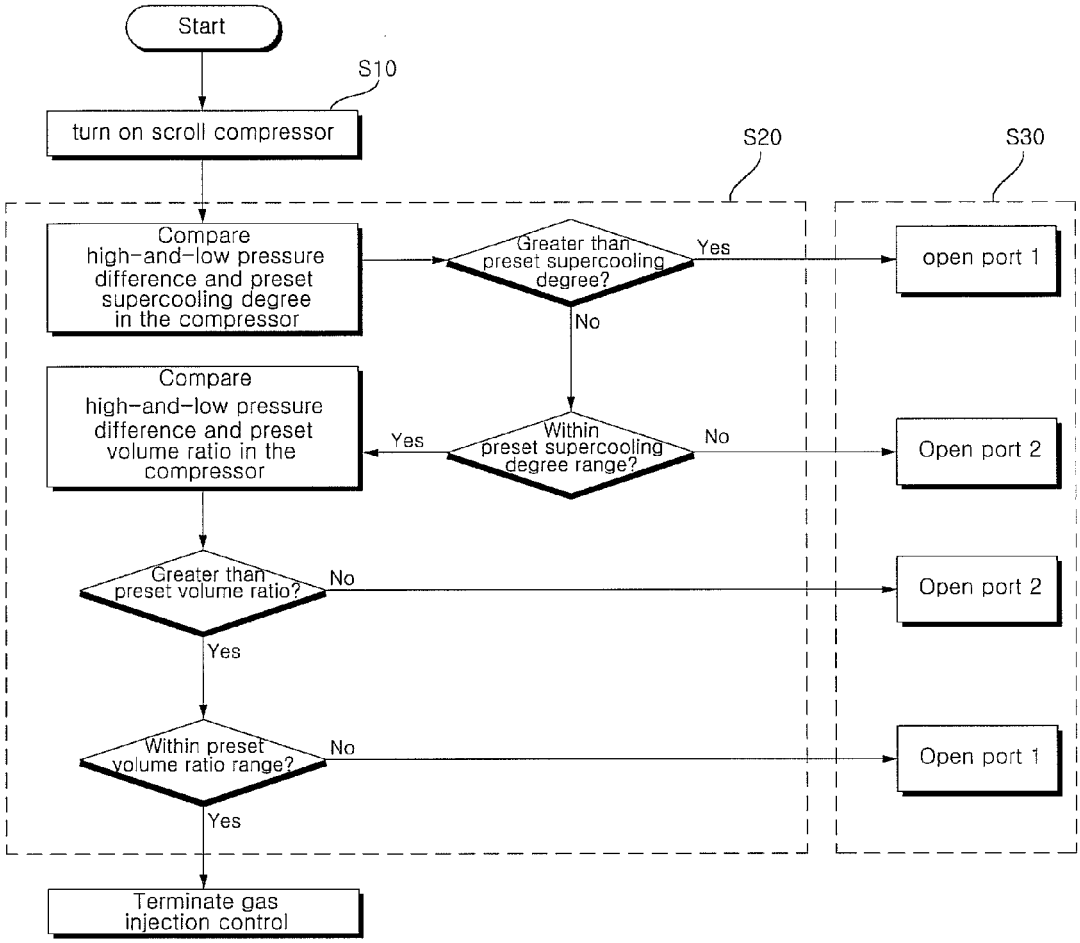
FIG. 7 is a flowchart of a method of controlling a heat pump according to an embodiment as broadly described herein.

Referring to FIG. 7, electric power is provided to the heat pump, and the scroll compressor 10 is turned on (S10).

Then, the state of coolant flowing through the coolant main path is determined by the scroll compressor 10 (S20).

Variables taken into consideration when determining the state of the coolant may include, for example, a compression ratio, a pressure ratio, and a supercooling degree of coolant before flowing into the scroll compressor 10.

Depending on the state of the coolant determined in step S20, the first coolant injection circuit 101*a* and the second coolant injection circuit 101*b*, connected to different locations between the coolant inlet and the coolant outlet of the scroll compressor 10, are activated or de-activated (S30).

In step S30, the coolants injected into the scroll compressor 10 through the first coolant injection circuit 101*a* and the second coolant injection circuit 101*b* are activated or de-activated to achieve the predetermined optimal middle pressures, wherein whether to activate or de-activate the first coolant injection circuit 101*a* and the second coolant injection circuit 101*b* may be determined by judging whether the coolants injected through the first coolant injection circuit 101*a* and the second coolant injection circuit 101*b* exceed of the respective predetermined supercooling degrees.

In step S30, in performing gas injection so that the coolants injected through the first coolant injection circuit 101*a* and the second coolant injection circuit 101*b* are gas injected to achieve the preset optimal middle pressure, it is judged whether a difference between the condensing pressure and evaporation pressure of the coolant injected through the first coolant injection circuit 101*a* is relatively large or whether the supercooling degree of the coolant condensed by the condenser exceeds a predetermined supercooling degree and whether a difference between the condensing pressure and evaporation pressure of the coolant injected through the second coolant injection circuit 101*b* is less than the difference between the condensing pressure and evaporation pressure of the coolant injected through the first coolant injection circuit 101*a* or whether the supercooling degree of the coolant condensed by the condenser exceeds the predetermined supercooling degree, thus determining whether to activate the first coolant injection circuit 101*a* and the second coolant injection circuit 101*b*.

Whether to activate the first coolant injection circuit 101*a* and the second coolant injection circuit 101*b* may be performed by controlling the first expander 32 and the second expander 34 that switch on/off the flow of coolants in the respective first coolant injection circuit 101*a* and second coolant injection circuit 101*b*.

Exemplary embodiments provide a heat pump that may enhance cooling/heating performance and a method of controlling the heat pump.

According to an embodiment as broadly described herein a heat pump may include a coolant main circuit that includes a scroll compressor, a condenser condensing a coolant passing through the scroll compressor, an expander expanding the coolant passing through the condenser, and an evaporator evaporating the coolant expanded by the expander, a first coolant injection circuit that is branched between the condenser and the evaporator and that is connected between a coolant inlet portion and a coolant outlet portion of the scroll compressor, and a second coolant injection circuit that is branched from the condenser and the evaporator and that is connected between the coolant inlet portion and the coolant outlet portion of the scroll compressor, wherein the first coolant injection circuit and the second coolant injection circuit are connected to different portions between the coolant inlet portion and the coolant outlet portion of the scroll compressor to have ideal preset middle pressures, respectively, respective of an evaporation temperature of the coolant, and wherein when the first and second coolant injection circuits are opened and closed to provide the respective preset middle pressures, a coolant injection circuit whose supercooling degree exceeds a preset supercooling degree respective of a condensation temperature of the coolant is inactivated.

The first coolant injection circuit may be branched from the coolant main circuit earlier than the second coolant injection circuit so that the first coolant injection circuit is connected to the scroll compressor to be close to the coolant outlet portion.

The scroll compressor may include a first coolant port connected to the first coolant injection circuit and communicating with an inside and an outside of the scroll compressor, and a second coolant port connected to the second coolant injection circuit and communicating with the inside and the outside of the scroll compressor.

The first coolant injection circuit may include a first expansion unit that expands the coolant and controls an opening degree to adjust the amount and flow of the coolant, and the second coolant injection circuit includes a second expansion unit that expands the coolant and controls an opening degree to adjust the amount and flow of the coolant.

The heat pump may also include a controller 200 that controls the opening degrees of the first and second expansion units.

Whether to activate the first and second coolant injection circuits may vary depending on whether the condensed coolant exceeds the preset supercooling degree.

Assuming that a middle pressure of the coolant expanded by the first expansion unit is a first middle pressure and a middle pressure of the coolant expanded by the second expansion unit is a second middle pressure, the first middle pressure is larger than the second middle pressure.

When the coolant is injected to the compressor so that the coolant flowing through one of the first and second coolant injection circuits has the preset middle pressure, if the coolant flowing through the first or second coolant injection circuit exceeds the preset supercooling degree, the first and second expansion units are controlled so that a corresponding coolant injection circuit is inactivated.

Assuming that a high-and-low pressure difference between the condensed coolant and the evaporated coolant corresponding to the first middle pressure is a first preset high-and-low pressure difference, and a high-and-low pressure difference between the condensed coolant and the evaporated coolant corresponding to the second middle pressure is a second preset high-and-low pressure difference, when a high-and-low pressure difference of the first coolant injection circuit is less than the first preset high-and-low pressure difference or a high-and-low pressure difference of the second coolant injection circuit is more than the second preset high-and-low pressure difference, a corresponding coolant injection circuit is inactivated.

Assuming that a volume ratio of the condensed coolant and the evaporated coolant corresponding to the first middle pressure is a first preset volume ratio and a volume ratio of the condensed coolant and the evaporated coolant corresponding to the second middle pressure is a second preset volume ratio, when a volume ratio of the first coolant injection circuit is less than the first preset volume ratio or a volume ratio of the second coolant injection circuit is more than the second preset volume ratio, a corresponding coolant injection circuit is inactivated.

A volume ratio (VR) of the compressor having the preset middle pressure of each coolant flowing through the first or second coolant injection circuit is calculated, and one of the first and second coolant injection circuits, which corresponds to the calculated volume ratio is activated.

The volume ratio (VR) of the compressor is calculated from a highness-and-lowness difference of the condensed pressure and evaporated pressure of each coolant flowing through the first or second coolant injection circuit, wherein the first or second coolant injection circuit is activated only when the condensed coolant has each preset supercooling degree before being injected to the first or second coolant injection circuit.

A method of controlling a heat pump as embodied and broadly described herein may include turning on a scroll compressor, determining a state of a coolant passing through a coolant main circuit through the scroll compressor, and activating or inactivating first and second coolant injection circuits connected to difference portions between a coolant inlet portion and a coolant outlet portion of the scroll compressor, the first and second coolant injection circuits are branched from the coolant main circuit depending on the determined state, wherein, activating or inactivating the first and second coolant injection circuits includes controlling first and second expansion units that are respectively provided in the first and second coolant injection circuits so that the first and second coolant injection circuits are activated such that the coolant injected to the compressor through the first and second coolant injection circuits has a preset middle pressure or such that the first and second coolant injection circuits are inactivated, wherein the first and second expansion units switch on/off a flow of the coolant in the coolant injection circuit.

Activating or inactivating the first and second coolant injection circuits may include determining whether the coolant injected through the first and second coolant injection circuits exceeds each preset supercooling degree while controlling the first and second expansion units.

A heat pump as embodied and broadly described herein may inject coolant into the scroll compressor to fit for the optimal middle pressure through the first or second coolant injection circuit, thus resulting in enhanced reliability and performance of the heat pump.

A heat pump as embodied and broadly described herein may previously calculate the optimal middle pressure and determines whether the calculated middle pressure is within a preset supercooling degree and a preset volume ratio to thereby activate the first and second coolant injection circuits. Accordingly, consumers' demand may be met by responding to each required load value.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A heat pump, comprising:

a coolant main circuit that includes a compressor, a condenser that condenses coolant compressed by the compressor, an expander that expands coolant condensed by the condenser, and an evaporator that evaporates coolant expanded by the expander;

a first coolant injection circuit that extends from a first point on the cooling main circuit between the condenser and the evaporator to a first point on the compressor between a coolant inlet and a coolant outlet thereof;

a second coolant injection circuit that extends from a second point on the cooling main circuit between the condenser and the evaporator and a second point on the compressor between the coolant inlet and the coolant outlet thereof, wherein the first and second points on the compressor are different to correspond to respective preset middle pressures based on an evaporation temperature of the coolant; and a controller configured to selectively open and close the first and second coolant injection circuits are opened and closed to generate the respective preset middle pressures, wherein the controller is configured to de-activate the first coolant injection circuit or the second coolant injection circuit when a respective supercooling degree exceeds a preset supercooling degree corresponding to a condensation temperature of the coolant.

2. The heat pump of claim 1, wherein the first point of the coolant main circuit from which the first coolant injection circuit is branched is upstream from the second point of the coolant main circuit from which the second coolant injection circuit is branched such that the first coolant injection circuit is connected to a portion of the compressor proximate the coolant outlet.

3. The heat pump of claim 2, wherein the first coolant injection circuit includes a first expander that expands the coolant, and wherein the controller controls an opening degree of the first expander to adjust an amount and flow of coolant therethrough, and the second coolant injection circuit includes a second expander that expands the coolant, and wherein the controller controls an opening degree of the second expander to adjust an amount and flow of coolant therethrough.

4. The heat pump of claim 3, wherein the controller is configured to selectively activate the first and second coolant injection circuits by adjusting respective opening degrees of the first and second expanders based on whether the condensed coolant exceeds the respective preset supercooling degree.

5. The heat pump of claim 3, wherein a first middle pressure of the coolant expanded by the first expander is greater than a second middle pressure of the coolant expanded by the second expander.

6. The heat pump of claim 5, wherein a high-and-low pressure difference between the condensed coolant and the evaporated coolant corresponding to the first middle pressure is a first preset high-and-low pressure difference, and a high-and-low pressure difference between the condensed coolant and the evaporated coolant corresponding to the second middle pressure is a second preset high-and-low pressure difference, and wherein the controller is configured to de-activate a corresponding one of the first or second coolant injection circuit when a high-and-low pressure difference of the first coolant injection circuit is less than the first preset high-and-low pressure difference or a high-and-low pressure difference of the second coolant injection circuit is greater than the second preset high-and-low pressure difference.

7. The heat pump of claim 5, wherein a volume ratio of the condensed coolant and the evaporated coolant corresponding to the first middle pressure is a first preset volume ratio and a volume ratio of the condensed coolant and the evaporated coolant corresponding to the second middle pressure is a second preset volume ratio, and wherein the controller is configured to de-activate a corresponding one of the first or second coolant injection circuits when a volume ratio of the first coolant injection circuit is less than the first preset volume ratio or a volume ratio of the second coolant injection circuit is greater than the second preset volume ratio.

8. The heat pump of claim 3, wherein the controller is configured to control the first and second expanders to de-activate the first coolant injection circuit when the coolant flowing through the first injection circuit exceeds the preset supercooling degree, and to de-activate the second coolant injection circuit when the coolant flowing through the second coolant injection circuit exceeds the preset supercooling degree.

9. The heat pump of claim 1, wherein the scroll compressor includes a first coolant port connected to the first coolant injection circuit and communicating with an inside and an outside of the scroll compressor, and a second coolant port connected to the second coolant injection circuit and communicating with the inside and the outside of the scroll compressor.

10. The heat pump of claim 9, wherein the first coolant injection circuit includes a first expander that expands the coolant, and wherein the controller controls an opening degree of the first expander to adjust an amount and flow of coolant therethrough, and the second coolant injection circuit includes a second expander that expands the coolant, and wherein the controller controls an opening degree of the second expander to adjust an amount and flow of coolant therethrough.

11. The heat pump of claim 1, wherein the controller is configured to calculate a volume ratio of the compressor having the preset middle pressure in each of the first and second coolant injection circuits, and to activate one of the first coolant injection circuit or the second coolant injection circuit which corresponds to the calculated volume ratio.

12. The heat pump of claim 11, wherein the controller is configured to calculate the volume ratio of the compressor is calculated based on a highness-and-lowness difference of the condensed pressure and evaporated pressure of the coolant flowing through the first or second coolant injection circuit, and to activate the first or second coolant injection circuit only when the condensed coolant corresponds to the preset supercooling degree before being injected into the first or second coolant injection circuit.

13. A method of controlling a heat pump, the method comprising:

activating a compressor;

determining a state of a coolant passing through a coolant main circuit of the compressor; and selectively activating and de-activating first and second coolant injection circuits, each of the first and second coolant injection circuits being branched off from the coolant main circuit and respectively connected to different points between a coolant inlet and a coolant outlet of the compressor, wherein selectively activating and de-activating the first and second coolant injection circuits comprises:

controlling first and second expanders respectively provided in the first and second coolant injection circuits to selectively activate at least one of the first or second coolant injection circuit such that coolant injected into the compressor through the at least one of the first or second coolant injection circuit has a preset middle pressure; and controlling the first and second expanders to selectively de-activate at least one of the first or second coolant injection circuit, wherein the first and second expanders selectively switch a coolant flow on and off in the first and second coolant injection circuits, respectively.

14. The method of claim 13, wherein controlling the first and second expanders to selectively de-activate at least one of the first or second coolant injection circuit comprises:

determining respective supercooling degrees of coolant injected through the first coolant injection circuit and the second coolant injection circuit;

de-activating the first coolant injection circuit when the determined supercooling degree exceeds a respective preset supercooling degree; and de-activating the second cooling injection circuit when the determined supercooling degree exceeds a respective preset supercooling degree.

* * * * *